US005197203A

United States Patent [19]

Lenoir

[11] Patent Number: 5,197,203

[45] Date of Patent: Mar. 30, 1993

[54] DRYING EQUIPMENT HAVING A FIRE PREVENTION SYSTEM

[75] Inventor: Patrick Lenoir, Villeneuve, France

[73] Assignee: Solaronics Vaneecke, Armentieres, France

[21] Appl. No.: 734,268

[22] Filed: Jul. 22, 1991

[30] Foreign Application Priority Data

Jul. 23, 1990 [FR] France ..... 90 09388

[51] Int. Cl.[5] ..... F26B 19/00

[52] U.S. Cl. ..... 34/90; 34/155

[58] Field of Search ..... 34/90, 41, 4, 17, 155; 169/46

[56] References Cited

U.S. PATENT DOCUMENTS 2,283,775 5/1942 Thompson ..... 169/46
2,292,794 8/1942 Paradise ..... 169/46
2,731,732 1/1956 Harris, Jr. et al. .
4,653,396 3/1987 Wennerberg ..... 169/46 X
4,658,716 4/1987 Boissevain ..... 34/41 X

FOREIGN PATENT DOCUMENTS 3809615 4/1989 Fed. Rep. of Germany .
2532733 3/1984 France .

*Primary Examiner*—Martin P. Schwadron
*Assistant Examiner*—Kevin L. Lee
*Attorney, Agent, or Firm*—Bachman & LaPointe

[57] ABSTRACT

A drying equipment comprised of a battery of radiant heaters, a suction hood and a blower hood. It is designed to dry a moving material, paper in particular, and is equipped with a fire prevention system integrated into its cowl. The fire prevention system comprises a spraying manifold supplying a flow of steam and then a steam and water mixture to reduce the temperature of the steam.

5 Claims, 2 Drawing Sheets

DRYING EQUIPMENT HAVING A FIRE PREVENTION SYSTEM

BACKGROUND OF THE INVENTION

1. Field of the invention

The present invention concerns drying equipment comprising a battery of radiant heaters for drying a webform material moving past a radiant surface formed by said radiant heaters, a suction hood and a blower hood disposed on respective sides of the battery of radiant heaters in the direction of movement of the webform material to delimit a volume between the radiant surface, the surface of the webform material to be dried and the hoods.

2. Description of the prior art

Radiant heaters of the kind in question, often disposed in a battery, are designed to be fitted to a papermaking machine to dry the paper.

The thermal inertia of these systems makes it necessary to apply fire prevention measures.

There are two series of causes of fires.

Firstly, if the paper or the dry material comes into contact with the infrared system it catches fire. This can occur at any time and principally if the paper breaks and if particles of paper are detached from the moving surface.

There is also a risk of fire if the web is stopped under the infrared system.

In this case the paper catches fire because of the high temperature and the presence of oxygen.

Currently radiant heaters are provided with cells which detect the variation or energy caused by the occurrence of a flame and trigger a water spraying system. The response time of a system of this kind is approximately 0.2 second.

A response time of this magnitude represents very long distances in the case of high-speed machines where the rate of movement is in excess of 600 meters per minute. This effectively reduces the effectiveness of such systems.

What is more, spraying water pollutes the paper because droplets of water fall onto the paper after setting.

Existing prior art fire prevention systems, such as disclosed in FR 2 532 733, are always disposed externally of the battery of radiant heaters. These systems usually employ manifolds installed at the outside of one of the hoods about ten centimeters from the outside wall.

This type of system must be mounted and demounted independently of the battery of radiant heaters. The major drawback of this system is that, given the relatively small distance between the hood and the material to be dried, the steam and water is difficult to remove from the hood and some of the steam systematically impinges under pressure on the hood where it condenses so that droplets of water drop onto the paper or the material to be dried.

This method of fire prevention therefore raises serious problems concerning its effectiveness, which the system in accordance with the invention proposes to solve.

SUMMARY OF THE INVENTION

The present invention consists in drying equipment comprising a battery of radiant heaters for drying a webform material moving past a radiant surface formed by said radiant heaters, a suction hood and a blower hood disposed on respective sides of the battery of radiant heaters in the direction of movement of the webform material to delimit a volume between the radiant surface, the surface of the webform material to be dried and the hoods, and a spraying system for producing a flow of steam to prevent fire, wherein said spraying system comprises a spraying manifold adapted to feed steam directly into said volume during a spraying cycle in response to detection of stopping of movement of the webform material in order to prevent fire.

The main advantages of a device of this kind are as follows:

Unlike water, steam is not a pollutant and there is no risk of it damaging the paper or other moving material to be dried.

As the manifolds are integrated into the infrared system, no droplet can drop onto the paper.

What is more, the integration of the steam manifolds into the infrared system makes it possible to concentrate a jet of steam where it is required, namely between the radiant plates and the surface to be treated.

The water flowrate required is less than the flowrates of the prior art devices.

What is more, the fact that water is sprayed into the steam lowers the temperature of the latter which improves its effectiveness and enhances the safety of personnel.

In a preferred embodiment the spraying manifold is disposed in the bottom part of the cowl of the aspiration hood where the temperature exceeds 130° C. Thus if there is any water in the steam it is systematically evaporated.

The invention is described in more detail below with reference to the drawings which show a single embodiment of the invention.

DETAILED DESCRIPTION OF THE INVENTION

Figure 1:
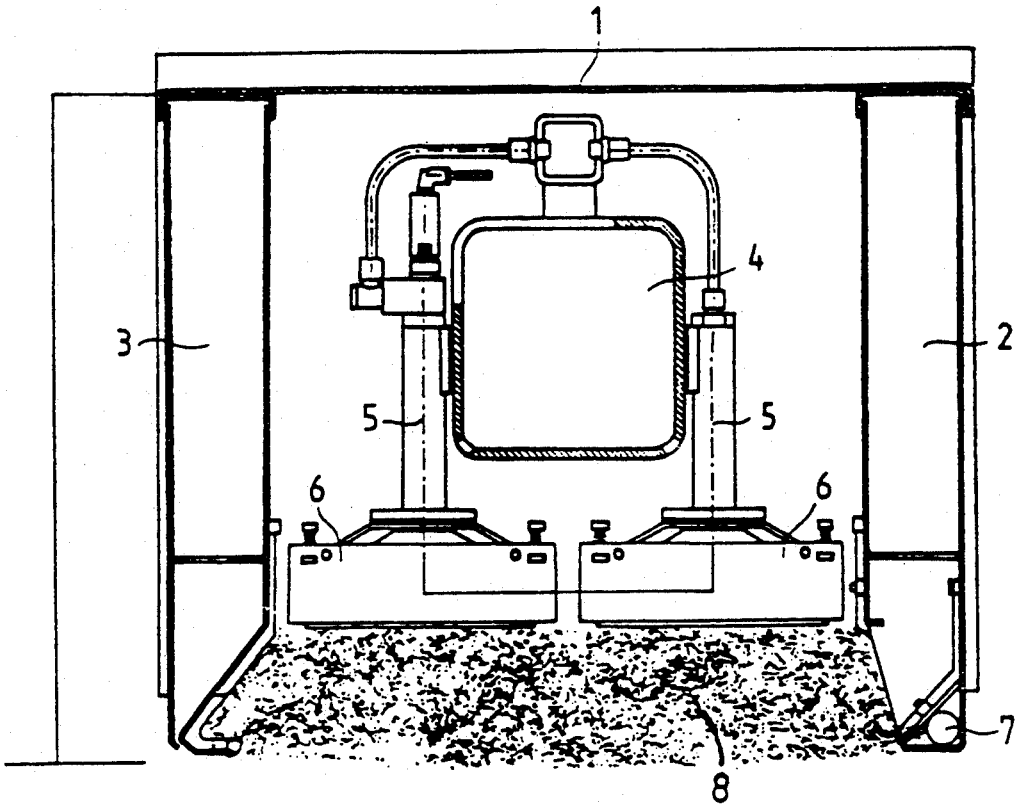
FIG. 1 is a front view of a closed type radiant heater equipped with a system in accordance with the invention.

FIG. 1 is a front view of a radiant heater of the type closed at the top by a cowl 1 and equipped with two lateral hoods, namely an aspiration hood 2 and a blower hood 3. Combustion-supporting air and fresh air are fed through a central duct 10 which includes lower orifices for evacuation of fresh air. The air and the gas are mixed in mixers 5 feeding active parts 6 of the radiant heaters.

The device includes a steam spraying manifold 7 integrated into the cowl of the radiant heater and disposed in a lower part of the suction hood 2.

The steam sprayed by the manifold 7 is denoted 8 in FIG. 1.

If the surface to be dried stops the manifolds 7 are activated automatically.

Figure 3:
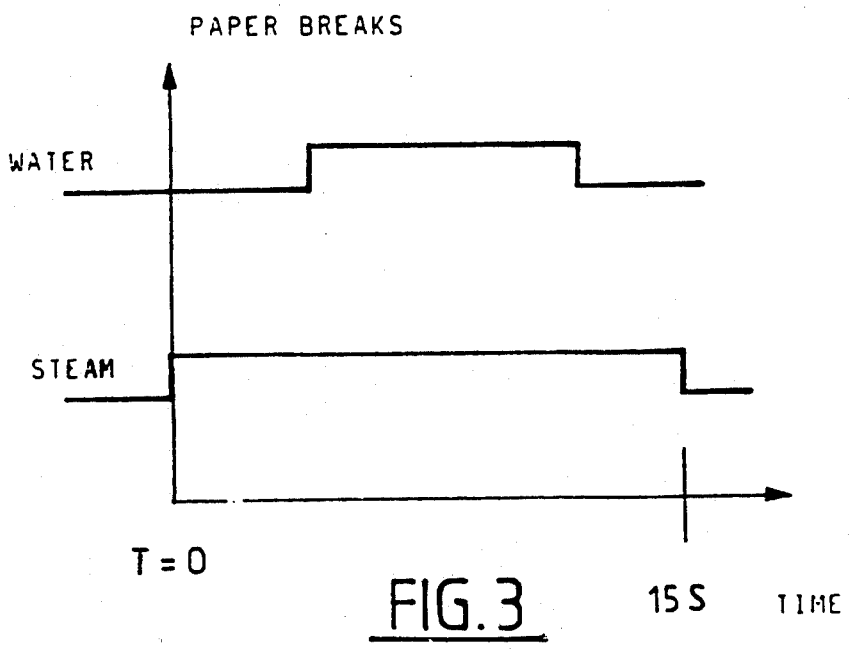
FIG. 3 is a graph showing the steam/water mixture spraying cycle.

As shown in FIG. 3, the stoppage may be due to the paper breaking and the manifold first dispenses steam with which water is mixed a few seconds later.

The graph in FIG. 3 shows that steam is fed into the manifold as soon as the paper or the material to be dried breaks. A few seconds later water is injected into the steam for reasons of safety and effectiveness. The steam being too dry, its temperature is reduced by increasing its moisture content. Of course, the water injected into the steam is converted into steam instantaneously.

The graph also shows that the addition of water is stopped before the injection of steam. This prevents any possibility of water droplets forming.

This fire prevention system prevents fire by eliminating air from in the volume delimited between the infrared surfaces 6 and the paper or other surface to be dried and the hoods by filling this space immediately with steam.

Consequently, on each stoppage an automatic control system feeds into a system of spraying manifolds 7 steam to which water is added; the steam preferably represents 1.6 $m^3$ of steam per kg at atmospheric pressure.

The cycle is entirely automated. Unlike water, steam does not pollute the surface of the paper. FIG. 3 shows that the automatic cycle has a duration of 15 seconds but a manual pushbutton is also provided for maintaining the system in operation if necessary.

Figure 2:
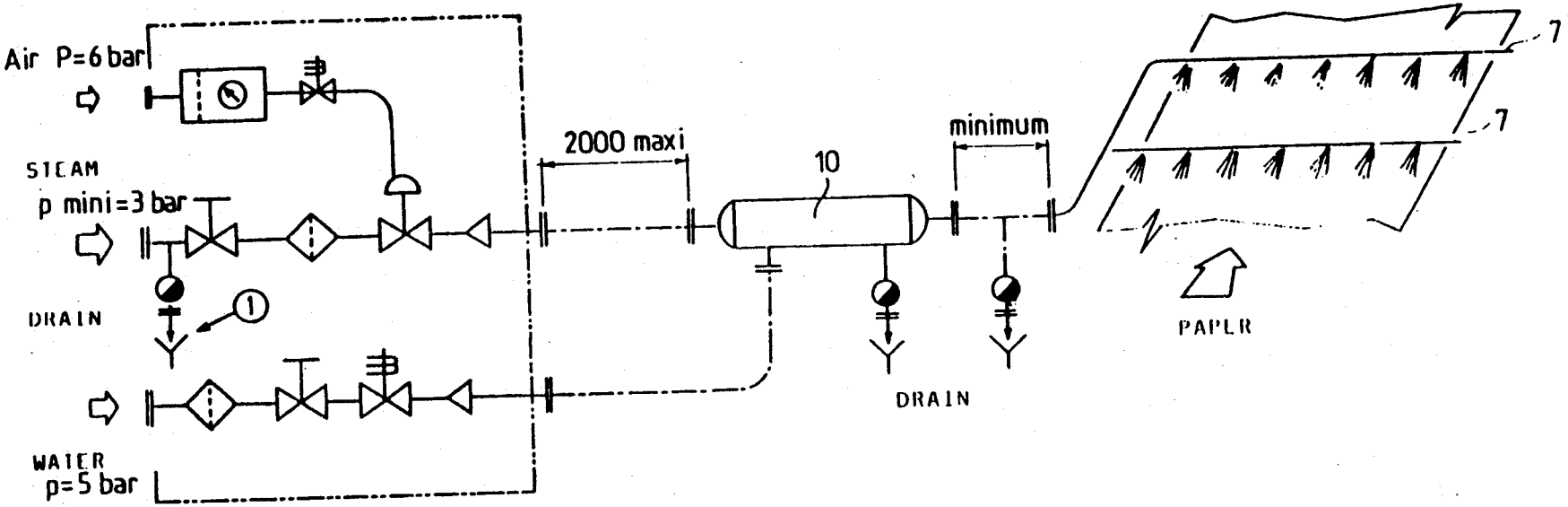
FIG. 2 is a diagram concerning the steam regulation function.

FIG. 2 is a diagram showing the device for supplying steam and water to the spraying manifolds 7.

FIG. 2 shows the steam regulation and steam/water mixing circuit. Air at a pressure of approximately 6 bars is fed into the steam at a minimum pressure of 3 bars. The pressurized steam is passed through a cooling tube 10 to which water is supplied at a pressure of about 5 bars. The steam/water mixture is then passed to the spraying manifolds 7.

There is claimed:

1. Drying equipment comprising a battery of radiant heaters for drying a webform material moving past a radiant surface formed by said radiant heaters, a suction hood and a blower hood disposed on respective sides of the battery of radiant heaters in the direction of movement of the webform material to delimit a volume between the radiant surface, the surface of the webform material to be dried and the hoods, and a spraying system for producing a flow of steam to prevent fire, wherein said spraying system comprises a spraying manifold adapted to feed steam directly into said volume during a spraying cycle in response to detection of stopping of movement of the webform material in order to prevent fire, wherein said spraying cycle also includes means for the addition of water to the steam during at least part of the spraying cycle.

2. Equipment according to claim 1 wherein said volume is filled with steam in less than 15 seconds.

3. Equipment according to claim 1 wherein water is added to said steam a few seconds after the start of the steam cycle, said injection of water being stopped a few seconds before the end of the steam cycle.

4. Equipment according to claim 1 wherein said spraying manifold is disposed in the lower part of the cowl of one of the hoods.

5. Equipment according to claim 4 wherein said spraying manifold is disposed in the lower part of the cowl of the suction hood.

* * * * *